US006402285B1

(12) United States Patent
Endo et al.

(10) Patent No.: US 6,402,285 B1
(45) Date of Patent: Jun. 11, 2002

(54) METHOD OF SUBJECTING INK JET PRINTER TO PREUSE TREATMENT

(75) Inventors: Toshihiro Endo, Tanashi; Mizue Fukushima, Tokorozawa; Makoto Yasunaga, Tanashi, all of (JP)

(73) Assignee: Citizen Watch Co., Ltd., Tokyo (JP)

( * ) Notice: Subject to any disclaimer, the term of this patent is extended or adjusted under 35 U.S.C. 154(b) by 0 days.

(21) Appl. No.: 09/509,441

(22) PCT Filed: May 29, 1998

(86) PCT No.: PCT/JP98/02388

§ 371 (c)(1),
(2), (4) Date: Mar. 28, 2000

(87) PCT Pub. No.: WO99/62720

PCT Pub. Date: Dec. 9, 1999

(51) Int. Cl.[7] ..... B41J 2/01
(52) U.S. Cl. ..... 347/19
(58) Field of Search ..... 347/19, 85, 86; 350/501, 406

(56) References Cited

U.S. PATENT DOCUMENTS 4,533,928 A * 8/1985 Sugiura et al. ..... 347/3
5,508,826 A * 4/1996 Lloyd et al. ..... 358/501

FOREIGN PATENT DOCUMENTS

| | | |
|---|---|---|
| JP | 8-118727 | 5/1996 |
| JP | 2671390 | 7/1997 |

* cited by examiner

*Primary Examiner*—Craig A. Hallacher
(74) *Attorney, Agent, or Firm*—Finnegan, Henderson, Farabow, Garrett & Dunner, L.L.P.

(57) ABSTRACT

A method of pretreating an ink-jet printer (10) before it is used is provided, wherein the printer includes a printing head (16) provided with a plurality of nozzles (28) for ejecting ink-droplets and movable in a reciprocating manner, an ink storage section (40) and an ink supply conduit (42) connecting the printing head with the ink storage section. The entirety of an ink flow passage including the ink supply conduit (42) is filled with a colored liquid material (78) having a function for maintaining the hydrophilic nature of the ink flow passage, before the ink-jet printer is forwarded from a factory. Then, before the ink-jet printer is assigned to the user, a printing operation is carried out by the printing head (16) by using the colored liquid material (78) and a character printed with the colored liquid material is observed to determine a printing function.

17 Claims, 6 Drawing Sheets

METHOD OF SUBJECTING INK JET PRINTER TO PREUSE TREATMENT

TECHNICAL FIELD

The present invention relates to a non-impact type printer, and particularly to a method of pretreating an ink-jet printer before it is used, including performing test printing. Further, the present invention relates to an ink-jet printer capable of carrying out such a pretreating method.

BACKGROUND ART

As non-impact type printers are less noisy during printing of characters or images and can perform color printing, they have been used in various fields. For example, an ink-jet printer wherein ink-droplets are ejected from a number of micro-nozzles provided in a printing head onto a material to be printed to carry out a printing operation, and particularly an on-demand type ink-jet printer wherein piezoelectric elements are used in the printing head, has recently prevailed as an output device for a personal computer or a word processor, because it can print on a plain paper and the printer body thereof is easily downsized.

On the other hand, impact type printers have relatively simple structures which makes the maintenance thereof easy and have advantages in running cost due to, e.g., an inexpensive ink ribbon, and thus have widely been used as printers for industrial use, such as a printer for printing on a bankbook or a slip in a bank (hereinafter referred to as a bankbook printer). Nowadays, however, even in the field of bankbook printers, requirements have been risen for, e.g., noise reduction, downsizing and an improvement in operation time (i.e., a time period required for user's operation between the introducing of a bankbook into the printer and the retaking thereof after being printed). Therefore, it becomes difficult to satisfy these requirements with the impact type printer.

One problem to be solved when an ink-jet printer is used as an industrial printer concerns pretreatment of the ink-jet printer, before it is used, which should be carried out on a secondary transportation. Note, secondary transportation means a step for transporting the ink-jet printer from a secondary base for shipment, storage or sale, wherein the printer is temporarily stored after being delivered from a factory, to an end user to whom the printer is assigned.

Conventionally, it is sometimes desired to confirm whether or not a printing mechanism of the ink-jet printer operates normally after the printer has been forwarded from the factory and before it is assigned to the end user. For instance, there is a case wherein, at a foreign sales base, a function for printing a particular language is optionally provided to the ink-jet printer in addition to an language printing function originally installed therein at the factory. In such a case, it is normal to confirm whether or not the added printing function normally operates, by actually operating the printing head to carry out a test printing.

Upon such a test printing, ink is necessarily supplied to a ink flow passage of the ink-jet printer. Then, it is desired for the ink supplied to the ink flow passage for the test printing to be completely discharged from the ink flow passage before sale, in order to not only prevent the ink from being dried to solidify or leaking and contaminating during the transportation but also make the ink-jet printer after the test printing appeared to be un-used to by a user. For this purpose, the washing operation of the ink flow passage becomes necessary, which burdens the secondary base with much work. Particularly, in some of the application fields of the ink-jet printer (for instance, in the field of bankbook printers) wherein a pigment ink using a pigment as a colorant is used, the washing operation of the ink flow passage is indispensable after the test printing.

In this regard, the ink flow passage of the ink-jet printer is generally filled with a liquid for maintaining a hydrophilic nature before the printer is forwarded from the factory for ensuring and maintaining the hydrophilic nature of the ink flow passage. If the hydrophilic nature of the ink flow passage is deteriorated, there is a tendency that bubbles are mixed in the ink when the ink is supplied to the ink flow passage for the actual use, and as a result, a correct printing becomes difficult. Accordingly, after the above-mentioned test printing, it is necessary to refill the liquid for maintaining hydrophilic nature into the ink flow passage, which further increases a work load on the secondary base.

DISCLOSURE OF THE INVENTION

It is an object of the present invention to provide a method of pretreating an ink-jet printer before it is used, which makes it possible to carry out test printing for confirming the printing function, without causing a problem of solidification and leakage of ink as well as a problem of a secondhand appearance prior to the delivery of the printer to the user.

Another object of the present invention is to provide a test printing method of an ink-jet printer, which can be carried out in such a pretreating method.

A further object of the present invention is to provide an ink-jet printer capable of carrying out such a pretreating method, and therefore can be used as an industrial printer, using a pigment ink, such as a bankbook printer.

A still further object of the present invention is to provide a package for an ink-jet printer suitable for carrying out such a pretreating method.

To accomplish the above objects, the present invention provides a method of pretreating an ink-jet printer before it is used, the ink-jet printer including a printing head provided with a plurality of nozzles for ejecting ink-droplets and movable in a reciprocating manner, an ink storage section and an ink supply conduit connecting the printing head with the ink storage section, the method comprising the steps of: (a) filling entirely an ink flow passage including the ink supply conduit with a colored liquid material having a function for maintaining the hydrophilic nature of the ink flow passage, before the ink-jet printer is forwarded from a factory; and (b) carrying out a printing operation by the printing head by using the colored liquid material and observing a character printed with the colored liquid material to determine a printing function, before the ink-jet printer is assigned to a user.

In the above pretreating method, the step (a) may include a step for storing the colored liquid material in the ink storage section.

The ink storage section may include an exchangeable ink tank, and the method may further comprise, after the step (b), a step for replacing the ink tank with another ink tank storing ink.

Also, the method may further comprises, prior to the step (b), a step for replacing a control circuit for printing predetermined language characters to another control circuit for printing the other language characters.

Preferably, the colored liquid material is made from an aqueous solution containing at least a humectant, a dyestuff and a surfactant.

Advantageously, the ink storage section is disposed apart from the printing head, and the ink supply conduit comprises a flexible tube extending between the printing head and the ink storage section.

The present invention also provides a test-printing method for determining a printing function of an ink-jet printer including a printing head provided with a plurality of nozzles for ejecting ink-droplets and movable in a reciprocating manner, an ink storage section and an ink supply conduit connecting the printing head with the ink storage section, the method comprising the steps of: (a) filling entirely an ink flow passage including the ink supply conduit with a colored liquid material having a function for maintaining the hydrophilic nature of the ink flow passage; (b) carrying out a printing operation by the printing head by using the colored liquid material; and (c) observing a character printed with the colored liquid material to determine a printing function.

In the above test-printing method, the step (a) may include a step for storing the colored liquid material in the ink storage section.

The ink storage section may include an exchangeable ink tank, and the method may further comprise, after the step (c), a step for replacing the ink tank with another ink tank storing ink.

The method may further include, prior to the step (b), a step for replacing a control circuit for printing predetermined language characters to another control circuit for printing other language characters.

The present invention also provides an ink-jet printer comprising: a printing head provided with a plurality of nozzles for ejecting ink-droplets and movable in a reciprocating manner; an ink storage section; an ink supply conduit connecting the printing head with the ink storage section; and a colored liquid material filled entirely in an ink flow passage including the ink supply conduit and having a function for maintaining hydrophilic nature of the ink flow passage; wherein a printing function can be determined through a printing operation performed by the printing head by using the colored liquid material, and through an observation of a character printed with the colored liquid material.

The above ink-jet printer may be used as a bankbook printer.

The present invention further provides a package for an ink-jet printer including a printing head provided with a plurality of nozzles for ejecting ink-droplets and movable in a reciprocating manner, an ink storage section and an ink supply conduit connecting the printing head with the ink storage section, the package comprising: a colored liquid material filled entirely in an ink flow passage including the ink supply conduit and having a function for maintaining the hydrophilic nature of the ink flow passage; a first seal member for sealing one opening end of the ink flow passage in a vapor-tight manner; and a second seal member for sealing another opening end of the ink flow passage in a hermetic manner.

BRIEF DESCRIPTION OF THE DRAWINGS

The above and other objects, features and advantages of the present invention will be described with reference to the embodiments illustrated in the attached drawings, wherein.

BEST MODES FOR CARRYING OUT THE INVENTION

Figure 1:
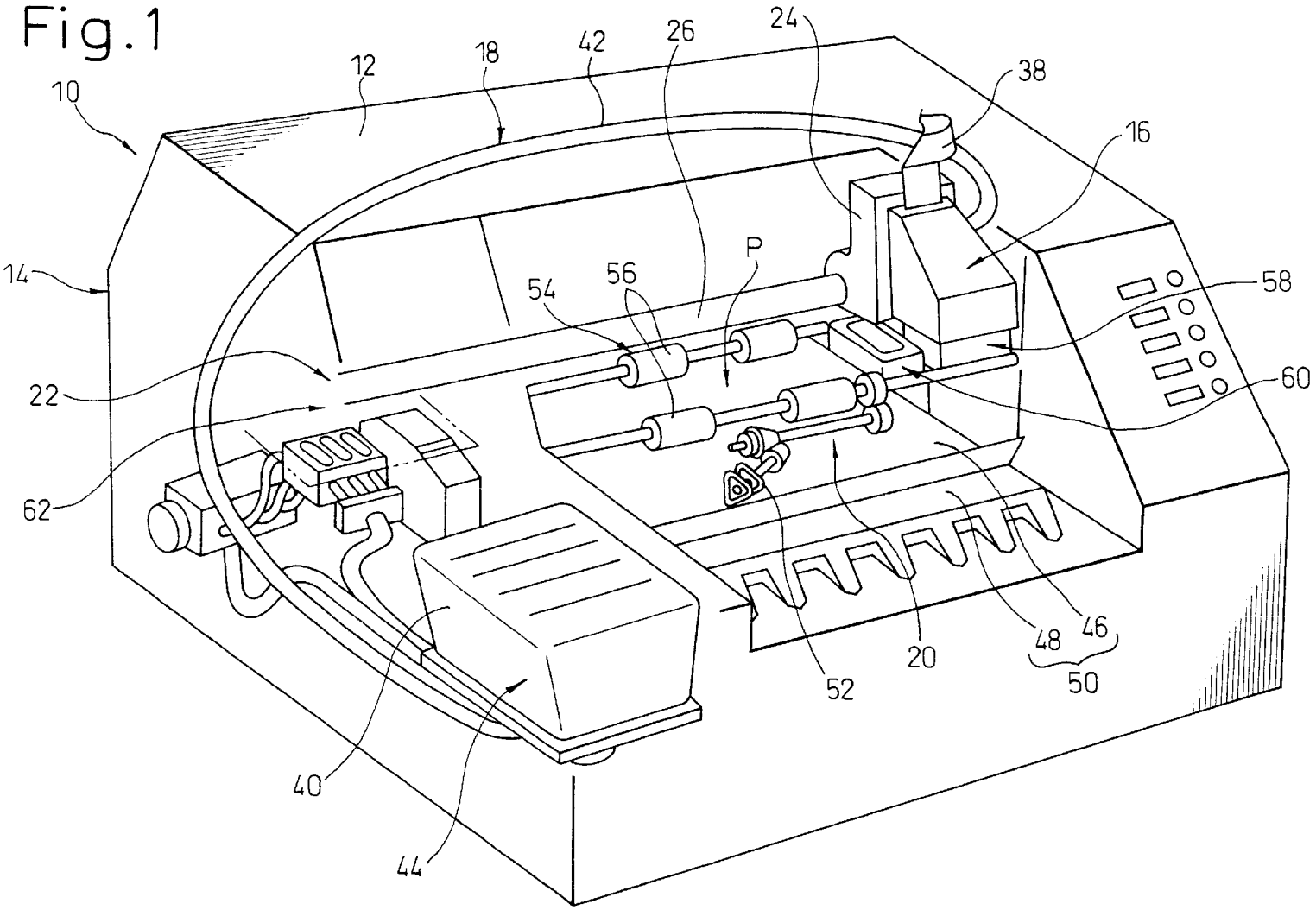
FIG. 1 is a schematic perspective view showing, in a partially cut-out manner, main components of an ink-jet printer capable of carrying out a method of pretreating before it is used, according to an embodiment of the present invention.

With reference to the attached drawings, FIG. 1 is a schematic perspective view showing, in a partially cut-out manner, main components of an ink-jet printer 10, according to one embodiment of the present invention, which can carry out a pretreating method before it is used, according to the present invention.

The ink-jet printer 10 is provided with a machine frame 14 including an openable/closable housing 12 and a machine base not shown, a printing head 16 provided reciprocatingly movably in a predetermined direction (usually in a horizontal direction relative to a reference plane on which the printer is installed) in the machine frame 14, ink-supply means 18 for supplying ink to the printing head 16, a material-feeding means 20 for feeding a material to be printed (not shown) into a printing area P opposed to the printing head 16 in the machine frame 14, and maintenance means 22 including a plurality of functional stations arranged in a distributed manner in opposite end regions of the reciprocation range of the printing head 16 in the machine frame 14.

The printing head 16 is fixed to a carriage 24 which, in turn, is carried on a guide bar 26 extending in the horizontal direction in the machine frame 14 so as to be slidingly movable in the axial direction of the bar. During the printing operation, the printing head 16 is reciprocated in the horizontal direction along the guide bar 26 by means of a driving mechanism not shown.

Figure 2:
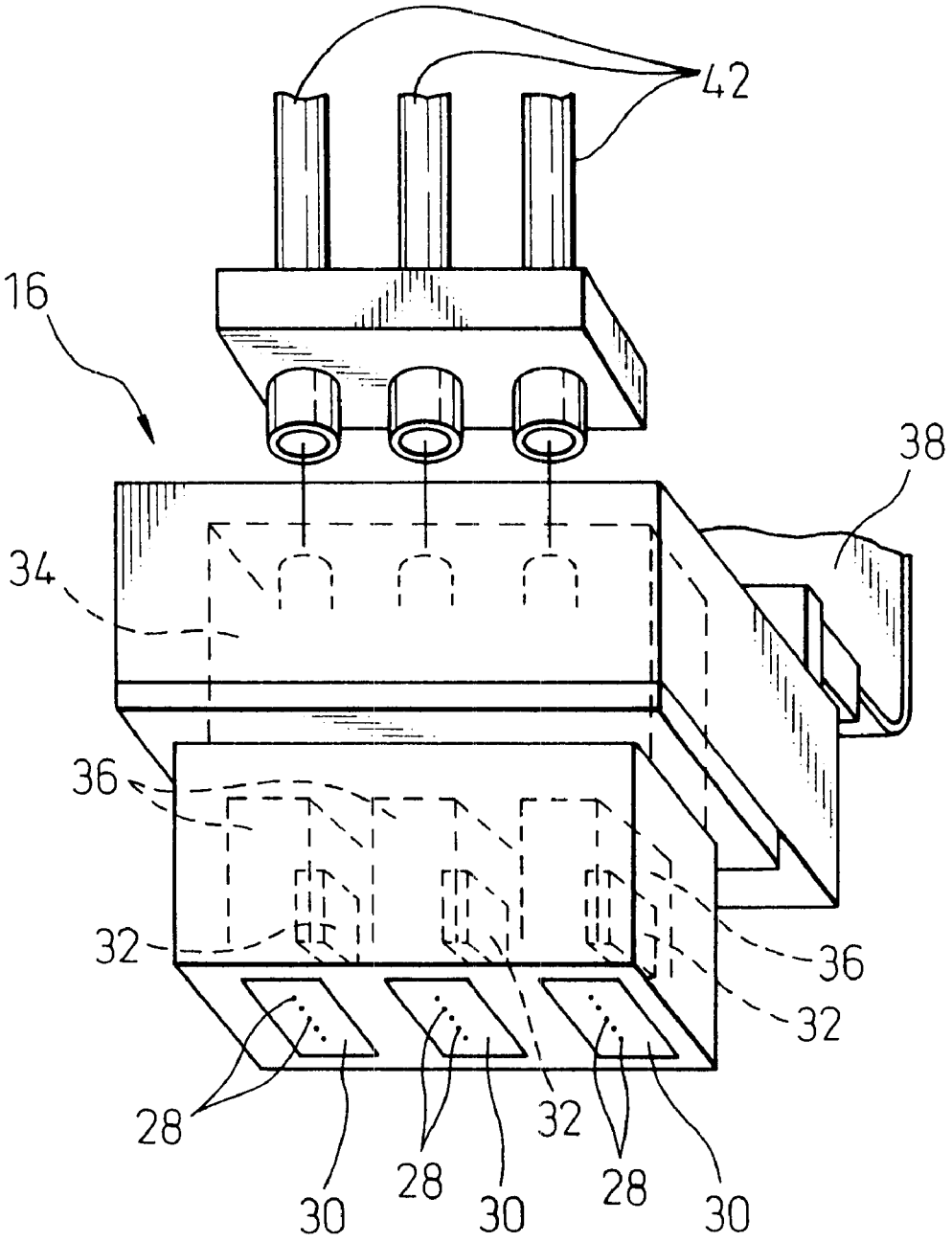
FIG. 2 is a schematic perspective view of a printing head of the ink-jet printer shown in FIG. 1.

As schematically shown in FIG. 2, the printing head 16 is provided with a plurality of nozzles 28 for ejecting ink-droplets, a nozzle surface 30 onto which the nozzles 28 open, an actuator 32 composed of piezoelectric elements for making the nozzles 28 eject ink-droplets, and an inner pressure-adjustment device or a damper 34 for stabilizing a meniscus of ink entering the respective nozzles 28. In the illustrated embodiment, the printing head 16 includes separate three subheads 36, each of which is provided with the plural nozzles 28, the nozzle surface 30 and the actuator 32. A flexible circuit board 38 for applying a driving voltage onto the actuator 32 is shown in FIGS. 1 and 2.

As shown in FIG. 1, the ink-supply means 18 is provided with an ink-storage section 40 arranged at position apart from the printing head 16 in the machine frame 14, and an ink-supply conduit 42 connecting the printing head 16 with the ink-storage section 40, to supply a pigment ink to the printing head 16 during the printing operation. In the illustrated embodiment, the ink-supply conduit 42 is formed of a sufficiently flexible tube so as not to interfere with the reciprocating motion of the printing head 16.

Figure 3:
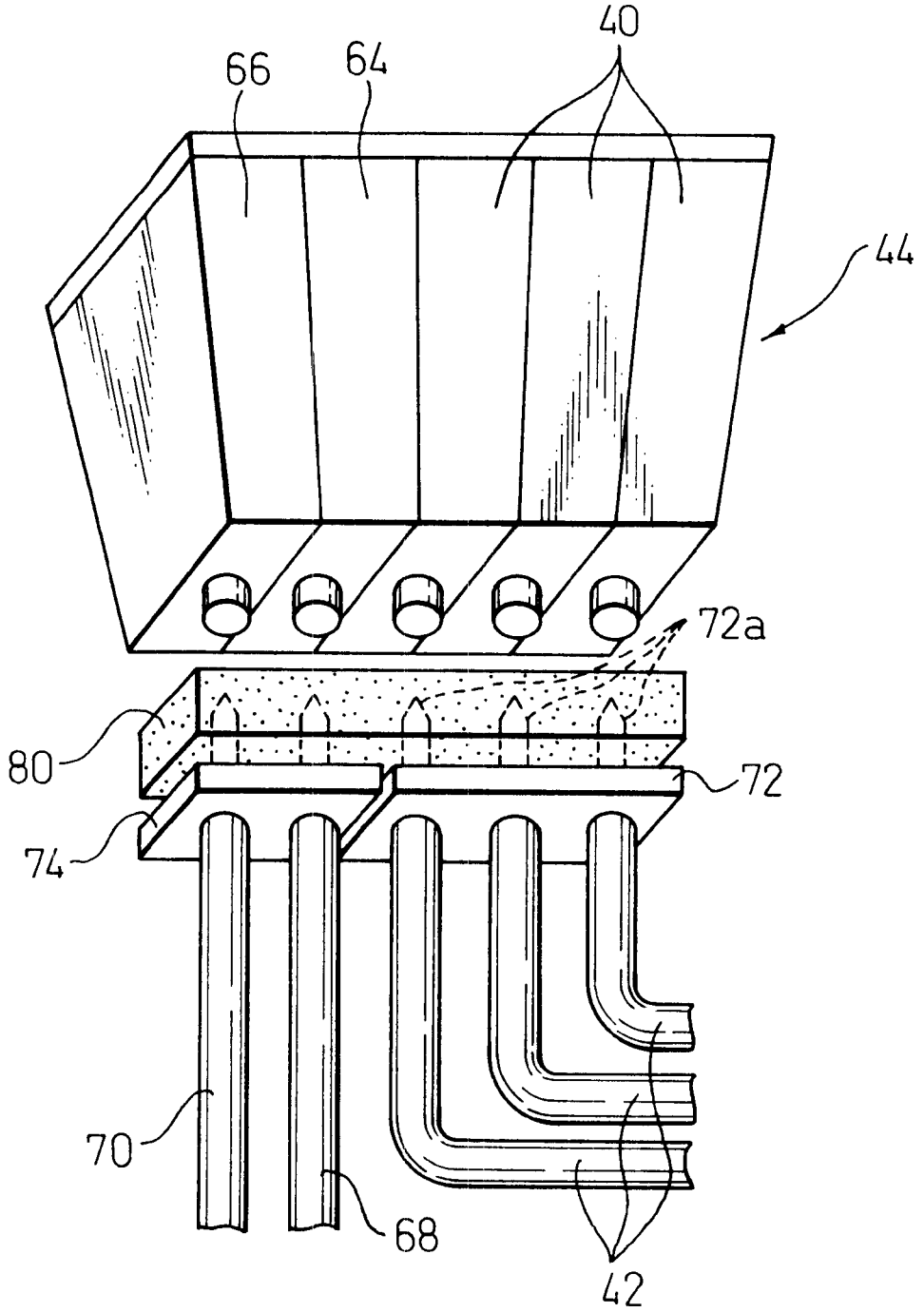
FIG. 3 is a schematic perspective view of an ink storage section of the ink-jet printer shown in FIG. 1.

Also in the illustrated embodiment, the ink-supply means 18 includes separate three ink-storage sections 40 and separate three ink-supply conduits 42 connecting the respective ink-storage sections 40 to the respective subheads 36 of the printing head 16 (see FIGS. 2 and 3). Accordingly, the ink-jet printer 10 is usable as a color printer. Further, in the illustrated embodiment, the three ink-storage sections 40 are formed within a cartridge type ink tank 44 detachably mounted at a predetermined position on the machine frame 14. In this regard, the number of the subheads 36, the ink-storage sections 40 and the ink-supply conduits 42 is not limited to three but may be variously selected.

The material-feeding means 20 disposed beneath a reciprocation range of the printing head 16 includes a material-holding section 50 having an upper fixed plate 46 and a lower movable plate 48 and holding the material to be printed, such as a printing paper or a bankbook, inserted between the plates 46, 48, a correcting mechanism 52 arranged above the fixed plate 46 for correcting the feeding direction of the material to be printed held in the material-holding section 50, and a feeding mechanism 54 disposed above the fixed plate at a position behind the correcting mechanism 52 in the material-feeding direction, for introducing the material to be printed held in the material-holding section 50 into the printing area P and discharging the same from the printing area P.

The printing area P is defined between two pairs of feed rollers 56 constituting the feeding mechanism 54. The printing head 16 reciprocates along the guide bar 26 above the printing area P, and scans the material to be printed introduced into the printing area P while forming characters or images on the material to be printed by ejecting ink-droplets from the nozzles 28.

The plural functional stations constituting the maintenance means 22 include a sealing station 58 for substantially sealing and covering the plural nozzles 28 opening on the nozzle surface 30 of the printing head 16 when the printer does not operate, so as to prevent the ink in the nozzles 28 from drying, a discharging station 60 for making the nozzles 28 of the printing head 12 discharge the ink with increased viscosity in the nozzles 28 when the printer does not operate, and a cleaning station 62 for sucking and removing the ink with increased viscosity in the nozzles 28 when the printer does not operate, and washing and wiping the nozzle surface 30. In the illustrated embodiment, the sealing station 58 and the discharging station 60 are disposed in one end region (a right end region in the drawing) of the reciprocation range R of the printing head, and the cleaning station 62 is disposed in another end region (a left end region in the drawing) of the reciprocation range R of the printing head.

Such a distributive arrangement of the various functional stations facilitates the effective utilization of an idle space in the machine frame 14 of the ink-jet printer 10. That is, in the general ink-jet printer, since the printing operation is carried out on the material to be printed while the printing head reciprocates in the predetermined direction, the reciprocation range of the printing head is determined to be wider than a dimension of the material-feeding device disposed opposite to the printing head. As a result, an idle space is inevitably formed around the material-feeding device. Therefore, in the ink-jet printer 10, the above-mentioned functional stations for establishing a multifunctional maintenance system are distributively arranged in the idle space, so as to effectively prevent the machine size from being enlarged. Further, the ink-jet printer 10 having such a multifunctional maintenance system can safely use pigment ink, and thus can be suitably applied to printers for industrial use, e.g., to a bankbook printer.

As shown in FIG. 3, the cartridge type ink tank 44 includes a washing liquid storage section 64 for storing a washing liquid to be supplied to a washing section of the cleaning station 62, disposed adjacent to the three ink storage sections 40, and a waste liquid storage section 66 for storing a waste ink collected from a sucking section of the cleaning station 62. The washing liquid storage section 64 and the waste liquid storage section 66 are connected to the cleaning station 62 via washing liquid conduit 68 and a waste liquid conduit 70, respectively. Also, the three ink-supply conduits 42 are connected to the three ink-storage sections 40, respectively, via a coupler 72 at one ends thereof. Similarly, the washing liquid conduit 68 and the waste liquid conduit 70 are connected to the washing liquid storage section 64 and the waste liquid storage section 66, respectively, via a coupler 74 at one end thereof.

Figure 4:
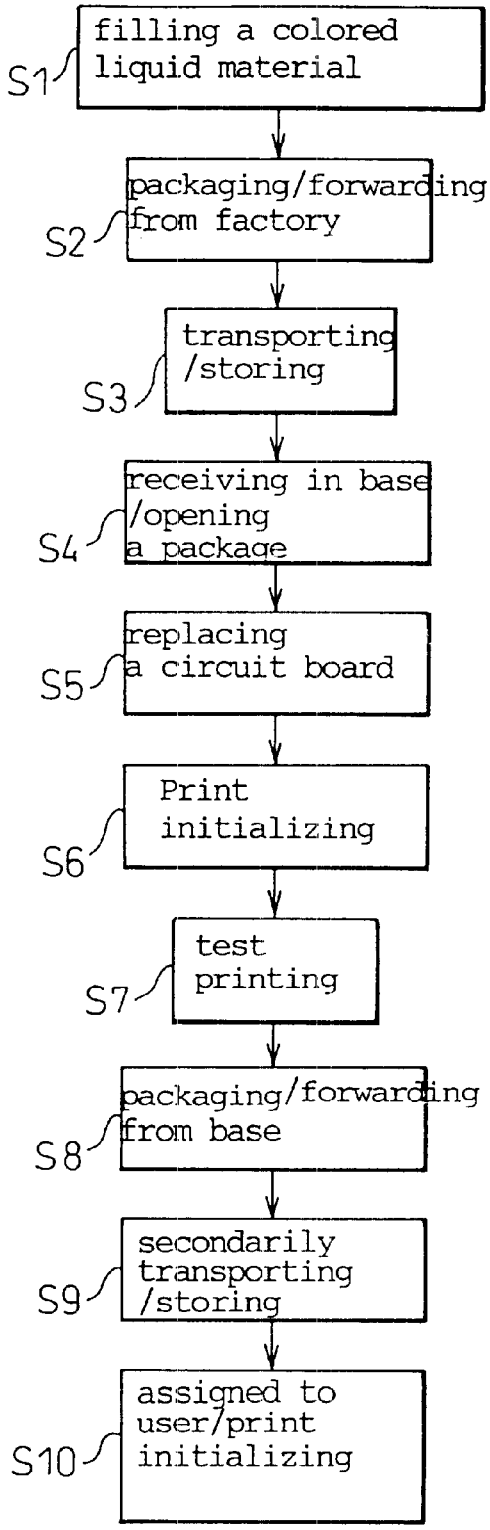
FIG. 4 is a flow chart illustrating the steps of the pretreating method according to the embodiment of the present invention.
Figure 5:
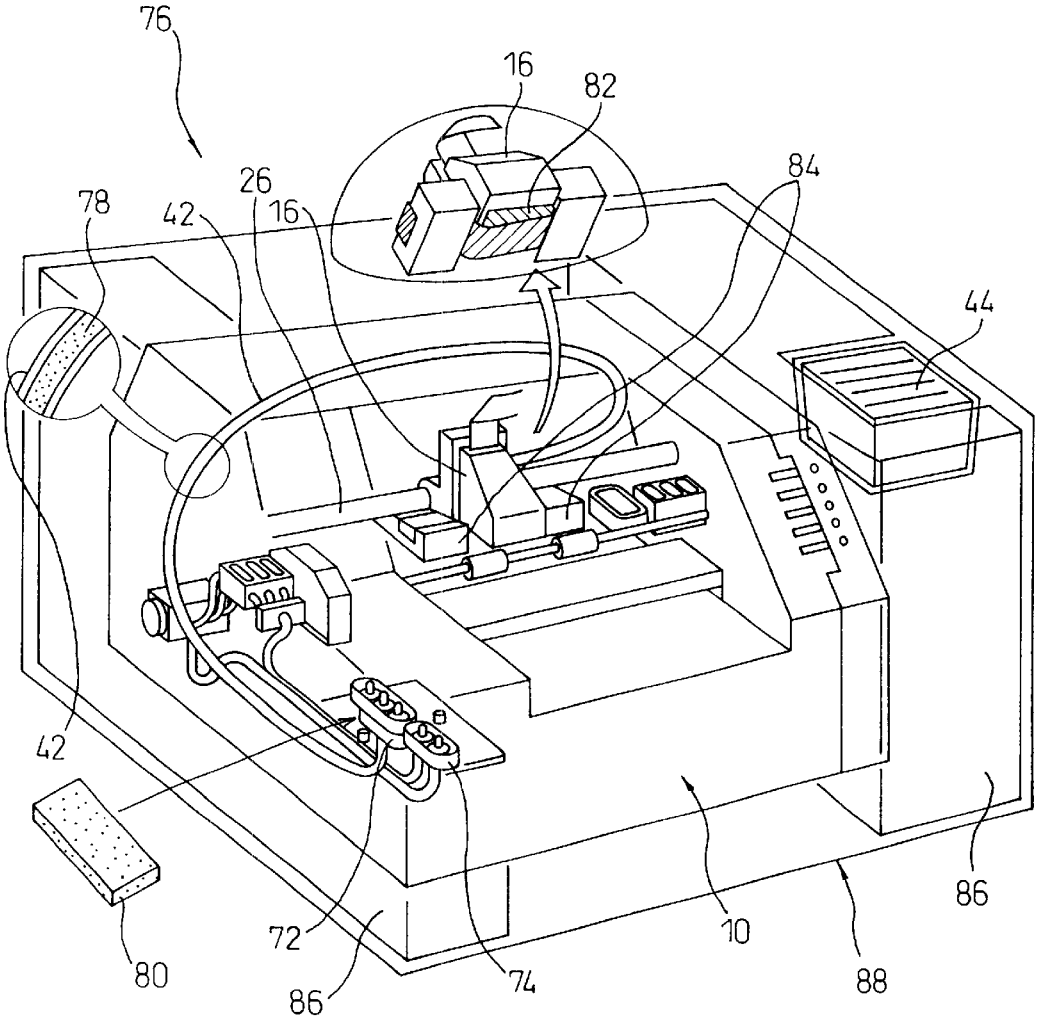
FIG. 5 is a schematic perspective view showing, in a partially cut-out manner, a package in the step of forwarding from a factory in the pretreating method of FIG. 4.
Figure 6:
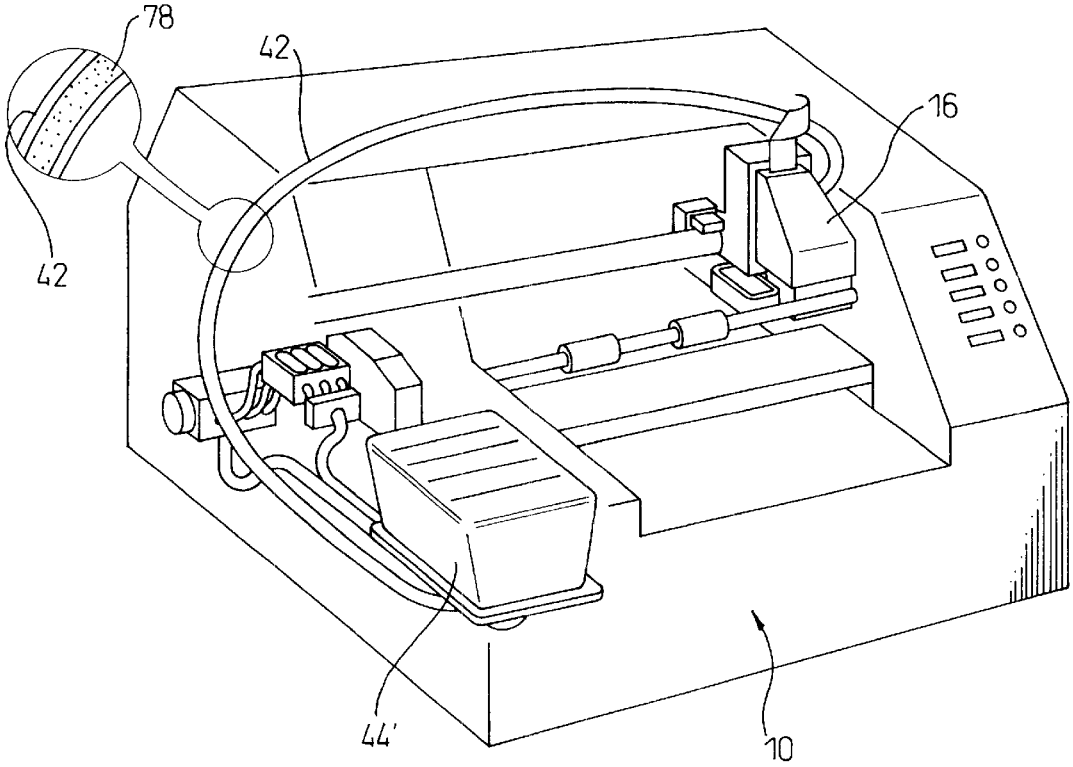
FIG. 6 is a schematic perspective view showing, in a partially cut-out manner, the ink-jet printer in the step of test printing in the pretreating method of FIG. 4.

In the ink-jet printer 10 having the above structure, it is possible to confirm whether or not a printing mechanism of the ink-jet printer 10 normally operates, after it has been forwarded from a factory and before it is assigned to an end user, by actually operating the printing head 16 to perform a test printing. A flow chart in FIG. 4 illustrates one embodiment of a pretreating method including such a test printing step carried out by the ink-jet printer 10. Also, FIG. 5 illustrates a package 76 of the ink-jet printer 10 suitable for carrying out the pretreating method shown in FIG. 4 when it is prepared to be forwarded from the factory, and FIG. 6 illustrates the ink-jet printer 10 set in an initial condition for carrying out the test printing.

The pretreating method according to one embodiment of the present invention will be described below with reference to FIGS. 4 to 6. First, in step S1, a colored liquid material 78 having a function for maintaining the hydrophilic nature of the ink flow passage is filled substantially in the entirety of the ink flow passage including the ink-supply conduit 42, before the ink-jet printer 10 is forwarded from the factory. In the illustrated embodiment, the entire ink flow passage is constituted from flow passage sections inside the coupler 72 connected to the ink storage sections 40 and flow passage sections extending via the three ink-supply conduits 42 and the damper 34 in the printing head 16 to the plurality of nozzles 28 in the three subheads 36.

The operation for filling the colored liquid material 78 can be carried out by the same process as in a conventional operation for filling a liquid for maintaining hydrophilic nature. In this regard, the conventional hydrophilic nature maintaining liquid is generally colorless or light-colored, and therefore even if the printing operation is carried out with such a hydrophilic nature maintaining liquid, the printed character or image is difficult to observe. Contrary to this, the colored liquid material 78 has a color which enables the character or image actually printed therewith to be visually observed and identified (e.g., a light-black color), provided the ground color of a material to be printed allows it.

The colored liquid material 78 is made of an aqueous solution containing at least a humectant, a dyestuff and a surfactant. The humectant is added for enhancing the function of the colored liquid material 78 for maintaining hydrophilic nature even though some of moisture in the colored liquid material 78 has evaporated in the case, e.g., where a longer time has lapsed from the forwarding of the printer from the factory to the delivery to the user. The humectant suitable for the present invention includes polyvalent alcohols such as glycerine, diethylene glycol, propylene glycol, polyethylene glycol; sugar-alcohols such as sorbitol; and pyrrolidone derivatives.

The dyestuff is added for enabling the characters printed with the colored liquid material 78 to be visible. The dyestuff suitable for the present invention is "Direct Black 19", "Direct Black 38", "Food Black 2", and so on. The surfactant has a function for lowering a surface tension of the colored liquid material 78 to improve the wettability so as to maintain the hydrophilic nature of a surface of the flow passage. The surfactant suitable for the present invention is an anionic surfactant such as ether-carboxylate, dialkylsulfosuccinate or sulfate; an amphoteric surfactant such as amino-acid type or betaine type; and a nonionic surfactant such as polyoxyethylene alkylether or polyoxyethylene fatty ester.

In step S2, the ink-jet printer 10, in which the ink flow passage is filled with the colored liquid material 78, is packed. At this time, passage open ends 72*a* (FIG. 3) of the coupler 72, which form one opening end of the ink flow passage, are sealed in an vapor-tight manner with a first seal member 80 made of, e.g., a sponge. The plural nozzles 28 (FIG. 2) of the printing head 16, which form the other opening end of the ink flow passage, are sealed in an air-tight manner with a second seal member 82 such as an adhesive tape. Thereby, it is possible to prevent the colored liquid material 78 in the ink flow passage from evaporating as well as to prevent the colored liquid material 78 from leaking out of the ink flow passage by the expansion thereof due to a temperature variation. On the contrary, the passage open ends 72*a* of the coupler 72 may be sealed with the second seal member in an air-tight manner, and the plural nozzles 28 of the printing head 16 may be sealed with the first seal member in a vapor-tight manner.

The ink-jet printer 10, in which the ink flow passage is sealed in this manner, is accommodated and packed in a separate box 88 by using predetermined pads 86, after the printing head 16 has been fixed on the guide bar 26 by a head-fastener 84. The ink tank 44 filled with ink and a washing liquid is also accommodated in the separate box 88 while being removed from the ink-jet printer 10. The package 76 is formed in this manner and is forwarded from the factory.

Next, the package 76 is transported and stored in a warehouse (step S3), and then is received in a secondary base for the purpose of shipment, stock or sale (step S4). In the secondary base, after the package 76 has been opened, a control circuit board (not shown) for printing predetermined language characters pre-installed in the ink-jet printer 10 before being forwarded from the factory is replaced, in step S5, with another control circuit board (not shown) for printing desired particular language characters, so as to optionally add to ink-jet printer 10 a function for printing such particular language characters.

Then, the first and second seal members 80, 82 used for sealing the ink flow passage are removed, and the ink-jet printer 10 is set in an initial condition for carrying out an ordinary printing operation (step S6). At this time, an ink tank 44' for a test printing, which is filled with the colored liquid material 78 and the washing liquid, is attached to the couplers 72, 74. Preferably, the ink tank 44' has the same structure as the ink tank 44 previously packed in the package 76. In this case, the colored liquid material 78 is stored in the three ink-storage sections (FIG. 3). The ink tank 44', may be supplied to the secondary base, for example, by a separate route.

After the initialization has completed, the printing head 16 is actually operated, in step S7, to carry out the test printing on the material to be printed fed to the printing area P (FIG. 1). In the test printing step, characters or images are printed on the material to be printed with the colored liquid material 78, and it is determined whether or not the printing is normally done, by visually observing these characters and images. Since the ink tank 44' filled with the colored liquid material 78 is mounted to the ink-jet printer 10 in this step, it is possible to perform an amount of printing sufficient for determining the printing function. If it is determined that the printing is abnormal, the printing function of the ink-jet printer 10 is adjusted so that the normal printing can be performed.

After the test printing has been completed, the ink tank 44' filled with the colored liquid material 78 is removed, in step S8, and the ink-jet printer 10 is reset into a condition where being forwarded from the factory (FIG. 5), so as to form the package 76. Although the colored liquid material 78 remains at that time within the ink flow passage of the ink-jet printer 10, this causes no problem since the colored liquid material 78 itself operates as a liquid for maintaining the hydrophilic nature and is composed of components difficult to dry as described before. Rather, it is preferred to leave the entire ink flow passage filled with the colored liquid material 78 for the purpose of maintaining the hydrophilic nature of the ink flow passage.

By sealing the ink flow passage with the first and second seal members 80, 82 in the same manner as when the ink-jet printer is forwarded from the factory, it is possible to prevent the colored liquid material 78 from leaking during the secondary transportation. Further, since the ink-jet printer 10 is in the same condition, even after the test printing, as when it is forwarded from the factory where the colored liquid material 78 is filled in the ink flow passage, there is no risk in that the user assumes that the printer is a secondhand one.

After being forwarded from the secondary base, the secondary package 76 thus formed is secondarily transported (step S9) and is stocked in a warehouse until, e.g., being ordered by a user. The user buying the ink-jet printer 10 can initialize it (step S10) in the same manner as in step S6, and attach the ink tank 44 filled with ink and washing liquid to the couplers 72, 74. In this manner, the pretreating method of the ink-jet printer 10 before being used is finished.

It should be noted that, in the pretreating method according to the present invention, it is not an indispensable constituent feature that the ink-jet printer is transported through the secondary base for the shipment, storage or sale. For instance, the test printing step in the pretreating method according to the above embodiment may be carried out within a factory for manufacturing the ink-jet printer as a test printing process for inspecting the printing function prior to forwarding the same from the factory.

INDUSTRIAL APPLICABILITY

In the present invention, the colored liquid material having a function of maintaining hydrophilic nature of the ink flow passage in an ink-jet printer is previously filled in the ink flow passage, so that the test printing for confirming the printing function of the ink-jet printer prior to the assignment to the user can be performed with the colored liquid material. Therefore, according to the present invention, it is possible to assign the ink-jet printer to the end user while leaving the colored liquid material in the ink flow passage even after the test printing. Further, since the present invention uses no ink upon the test printing, it is particularly suitably applied to industrial printers using a pigment ink, such as bankbook printers.

What is claimed is:

1. A method of pretreating an ink-jet printer before it is used, the ink-jet printer including a printing head provided with a plurality of nozzles for ejecting ink-droplets and movable in a reciprocating manner, an ink storage section and an ink supply conduit connecting the printing head with the ink storage section, the method comprising the steps of:

(a) filling entirely an ink flow passage including said ink supply conduit with a colored liquid material having a function for maintaining a hydrophilic nature of said ink flow passage, before the ink-jet printer is forwarded from a factory; and (b) carrying out a printing operation by said printing head by using said colored liquid material and observing a character printed with said colored liquid material to determine a printing function, before the ink-jet printer is assigned to a user.

2. A pretreating method as set forth in claim 1, wherein said step (a) includes a step of storing said colored liquid material in said ink storage section.

3. A pretreating method as set forth in claim 2, wherein said ink storage section includes an exchangeable ink tank, and further comprising, after said step (b), a step of replacing said ink tank with another ink tank storing ink.

4. A pretreating method as set forth in claim 1, further comprising, prior to said step (b), a step of replacing a control circuit for printing predetermined language characters to another control circuit for printing other language characters.

5. A pretreating method as set forth in claim 1, wherein said colored liquid material is made from an aqueous solution containing at least a humectant, a dyestuff and a surfactant.

6. A pretreating method as set forth in claim 1, wherein said ink storage section is disposed apart from said printing head, and said ink supply conduit comprises a flexible tube extending between said printing head and said ink storage section.

7. A test-printing method for determining a printing function of an ink-jet printer including a printing head provided with a plurality of nozzles for ejecting ink-droplets and movable in a reciprocating manner, an ink storage section and an ink supply conduit connecting the printing head with the ink storage section, the method comprising the steps of:

(a) filling entirely an ink flow passage including said ink supply conduit with a colored liquid material having a function for maintaining a hydrophilic nature of said ink flow passage;

(b) carrying out a printing operation by said printing head by using said colored liquid material; and (c) observing a character printed with said colored liquid material to determine a printing function.

8. A test-printing method as set forth in claim 7, wherein said step (a) includes a step of storing said colored liquid material in said ink storage section.

9. A test-printing method as set forth in claim 8, wherein said ink storage section includes an exchangeable ink tank, and further comprising, after said step (c), a step of replacing said ink tank with another ink tank storing ink.

10. A test-printing method as set forth in claim 7, further comprising, prior to said step (b), a step of replacing a control circuit for printing predetermined language characters to another control circuit for printing other language characters.

11. A test-printing method as set forth in claim 7, wherein said colored liquid material is made from an aqueous solution containing at least a humectant, a dyestuff and a surfactant.

12. A test-printing method as set forth in claim 7, wherein said ink storage section is disposed apart from said printing head, and said ink supply conduit comprises a flexible tube extending between said printing head and said ink storage section.

13. An ink-jet printer comprising:

a printing head provided with a plurality of nozzles for ejecting ink-droplets and movable in a reciprocating manner;

an ink storage section;

an ink supply conduit connecting said printing head with said ink storage section; and a colored liquid material filled entirely in an ink flow passage including said ink supply conduit and having a function for maintaining a hydrophilic nature of said ink flow passage;

wherein a printing function can be determined through a printing operation performed by said printing head by using said colored liquid material, and through an observation of a character printed with said colored liquid material.

14. An ink-jet printer as set forth in claim 13, wherein said colored liquid material is made from an aqueous solution containing at least a humectant, a dyestuff and a surfactant.

15. An ink-jet printer as set forth in claim 13, wherein said ink storage section is disposed apart from said printing head, and said ink supply conduit comprises a flexible tube extending between said printing head and said ink storage section.

16. An ink-jet printer as set forth in claim 13, which is used as a bankbook printer.

17. A package for an ink-jet printer including a printing head provided with a plurality of nozzles for ejecting ink-droplets and movable in a reciprocating manner, an ink storage section and an ink supply conduit connecting the printing head with the ink storage section, the package comprising:

a colored liquid material filled entirely in an ink flow passage including said ink supply conduit and having a function for maintaining a hydrophilic nature of said ink flow passage;

a first seal member for sealing one opening end of said ink flow passage in a vapor-tight manner; and a second seal member for sealing another opening end of said ink flow passage in a hermetic manner.

* * * * *